US008328992B1

(12) United States Patent
Swain

(10) Patent No.: US 8,328,992 B1
(45) Date of Patent: Dec. 11, 2012

(54) RETORT

(76) Inventor: Lloyd W. Swain, Vernal, UT (US)

( * ) Notice: Subject to any disclaimer, the term of this patent is extended or adjusted under 35 U.S.C. 154(b) by 17 days.

(21) Appl. No.: 12/854,826

(22) Filed: Aug. 11, 2010

Related U.S. Application Data

(63) Continuation of application No. 12/841,956, filed on Jul. 22, 2010, now abandoned.

(60) Provisional application No. 61/227,958, filed on Jul. 23, 2009.

(51) Int. Cl.
*C10B 1/00* (2006.01)

(52) U.S. Cl. ..... 202/108; 202/113; 202/115; 202/116

(58) Field of Classification Search ..... 201/17, 201/22, 23, 35, 40; 202/99, 103, 104, 108, 202/113, 115, 116
See application file for complete search history.

(56) References Cited

U.S. PATENT DOCUMENTS

| | | | | |
|---|---|---|---|---|
| 813,726 | A * | 2/1906 | Marconnet | 48/73 |
| 1,089,110 | A * | 3/1914 | Chappell | 432/85 |
| 1,967,691 | A * | 7/1934 | Traut | 202/104 |
| 2,560,767 | A * | 7/1951 | Huff | 201/29 |
| 3,663,421 | A * | 5/1972 | Parr | 208/409 |
| 3,794,565 | A * | 2/1974 | Bielski | 202/100 |
| 4,038,154 | A * | 7/1977 | Barnebey | 202/93 |
| 5,296,005 | A * | 3/1994 | Wolfe et al. | 44/551 |
| 7,264,694 | B2 * | 9/2007 | Merrell et al. | 202/105 |

FOREIGN PATENT DOCUMENTS

| | | | |
|---|---|---|---|
| JP | 62034984 | * | 2/1987 |

* cited by examiner

*Primary Examiner* — Robert A Hopkins
(74) *Attorney, Agent, or Firm* — Polsinelli Shughart PC

(57) ABSTRACT

A retort involves a stack of retort units arranged to process coal or other raw material by heating the coal in a heating compartment and directing vapors emitted from the raw material into a vapor compartment surrounding the heating compartment. The heating compartment may include a plurality of louver units with embedded heating components. Each louver unit includes heating fins (a heat transfer medium) that delivers heat to the coal. Each louver unit also includes an insulation layer adjacent a vapor opening where vapors emitted from the coal pass into the vapor compartment. The vapors are directed to a distillation column where carbon based vapors, volatiles, fuel vapors and the like may be liquefied for transport to a refinery or directly refined into fuels. Further, a clean coal char (toxins and carbon vaporized) is delivered to a power generation plant to provide cleaner emissions relative to unprocessed coal.

5 Claims, 19 Drawing Sheets

RETORT

CROSS-REFERENCE TO RELATED APPLICATION

The present application is a continuation application claiming the benefit of U.S. patent application Ser. No. 12/841,956 titled "Retort" filed Jul. 22, 2010, now abandoned which claims the benefit under 35 U.S.C. §119(e) of U.S. Provisional Application No. 61/227,958 titled "Retort" filed on Jul. 23, 2009, the entire contents of each of which are incorporated herein by reference.

FIELD OF INVENTION

Aspects of the present invention generally relate to a retort system and method for using the same to process coal or other raw materials.

BACKGROUND

Coal is a readily available fuel source throughout much of the world and is used extensively in electricity generation. However, coal production and many coal-based power generation systems are accompanied by various environmental impacts, principle among them being carbon dioxide emissions. Given the abundance of coal and ever increasing global energy demands, significant efforts are being made and have been made to develop technologies that use coal in more environmentally friendly ways and more efficiently than simply burning coal, such as coal gasification, coal liquefaction, ethanol production using coal, and various ways to improve the efficiency and reduce carbon dioxide emissions from coal burning power plants. Moreover, there are significant efforts being devoted to so called "clean coal" technologies. It is unclear whether any particular technology will emerge as a leader over all other technologies. Rather, these various technologies, as well as others, are in numerous forms and each has advantages and disadvantages. It is clear, however, that there is and will be a need for technologies that can process coal, as well as other materials such as oil shale, efficiently and with reduced environmental impact.

DETAILED DESCRIPTION

Aspects of the invention involve a retort unit, a collection of modular retort units forming a retort system and related methods. The retort units are arranged to process coal or other raw material by heating the coal in a heating compartment and directing vapors emitted from the raw material into a vapor compartment surrounding the heating compartment. In one possible implementation, the heating compartment includes a plurality of louver units with embedded heating components. Each louver unit includes a plurality of heating fins, arranged as a heat transfer medium, that delivers heat energy to the raw material within the heating compartment. Each louver unit also includes an insulation layer adjacent a vapor opening within the heating chamber and where vapors emitted from the raw material escape into the vapor compartment. The vapors collected within the vapor chamber are directed to a distillation column where carbon based vapors, volatiles, fuel vapors and the like may be liquefied for transport to a refinery or directly refined into fuels. The retort units deliver a clean coal char that may be burned in a power generation plant cleaner than raw coal material, for example, as many toxins, including carbon products, are vaporized and removed from the coal in the retort.

Figure 1:
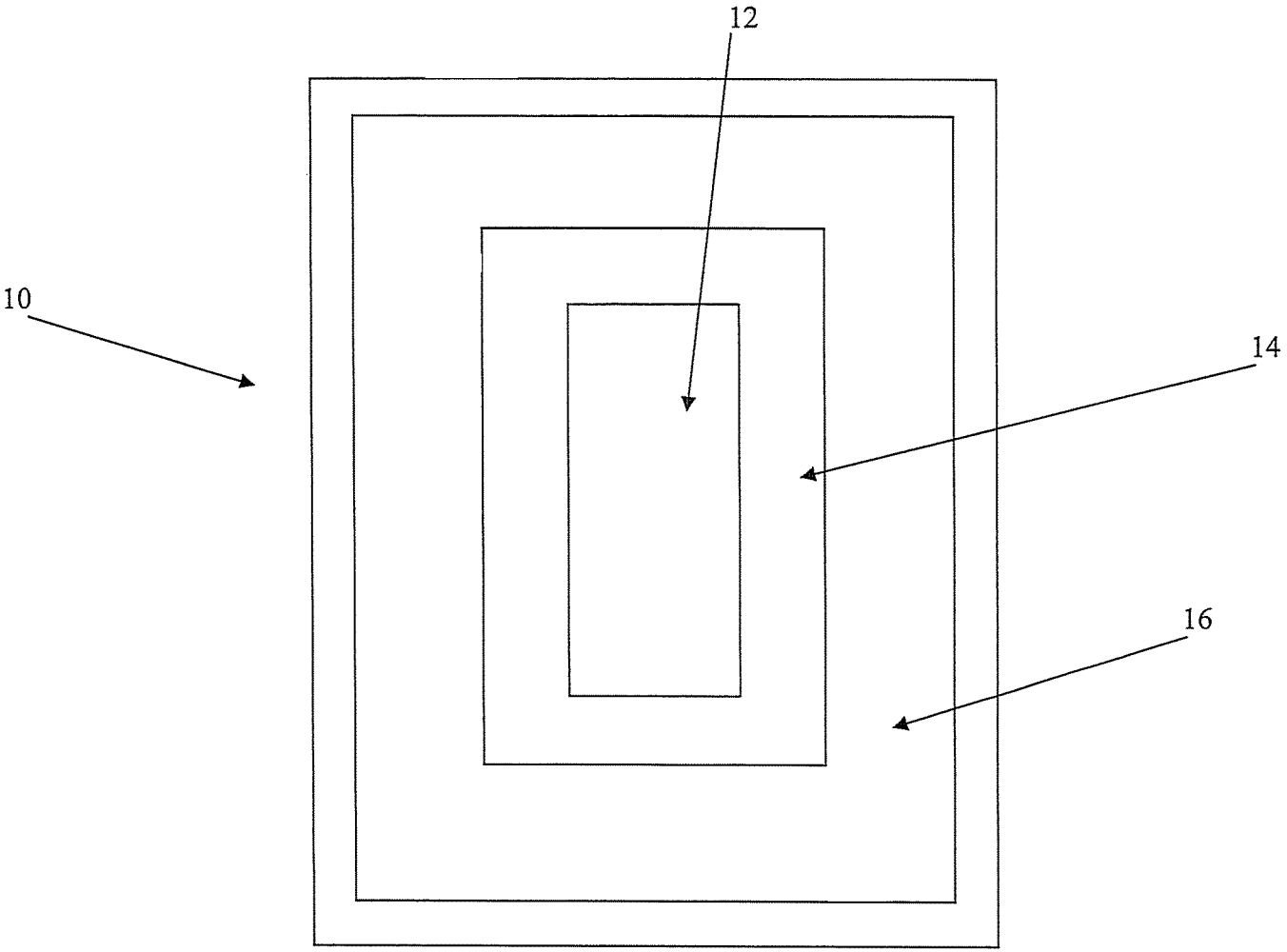
FIG. 1 is a schematic top view of a retort unit with a heating compartment surrounded by a vapor compartment.

FIG. 1 is a schematic top view of a modular retort unit 10. The retort unit includes a heating compartment 12 in the form of a substantially enclosed column in the middle of the unit. The heating compartment is surrounded by a vapor compartment 14. Coal or other material is conveyed, fed or otherwise deposited in the heating compartment where the coal is heated. A vacuum is placed on the unit, particularly the heating chamber, and the chambers are sealed to provide an oxygen free environment so that the coal within the heating chamber does not ignite. The vacuum may be achieved with a fan that also serves the purpose of pulling vapors from the vapor compartment and conveying those vapors to external processing. Through the heating process, the coal expels various vapors at different temperatures. For example, butane, propane and naphtha vapors are expelled at lower temperature ranges and gasoline, asine and decal vapors are expelled at higher temperatures. The vapors move from the heating chamber into the vapor chamber.

The vapor compartment is enclosed by insulation 16. The insulation helps to maintain the vapor compartment and heating compartment at appropriate temperatures, prohibit excessive heat loss, and positively influence the efficiency of the unit. When using the retort to process coal, in one possible implementation, one or more retort units arranged in a stack, as discussed herein, will be heated up to 900-1030 degrees Fahrenheit; hence, any insulation material should be suitable to handle such temperatures.

Figure 2:
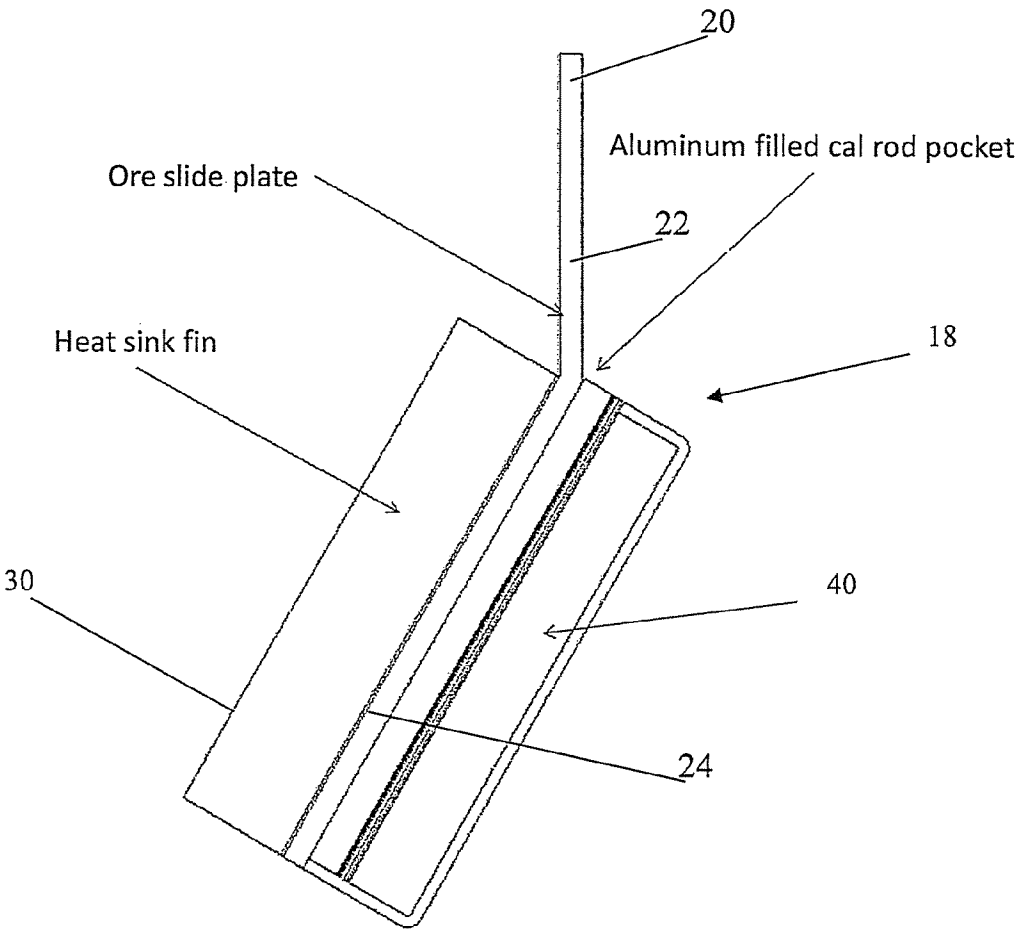
FIG. 2 is a side view of a pair of louver heating units arranged as disposed within a heating compartment of the retort unit.
Figure 3:
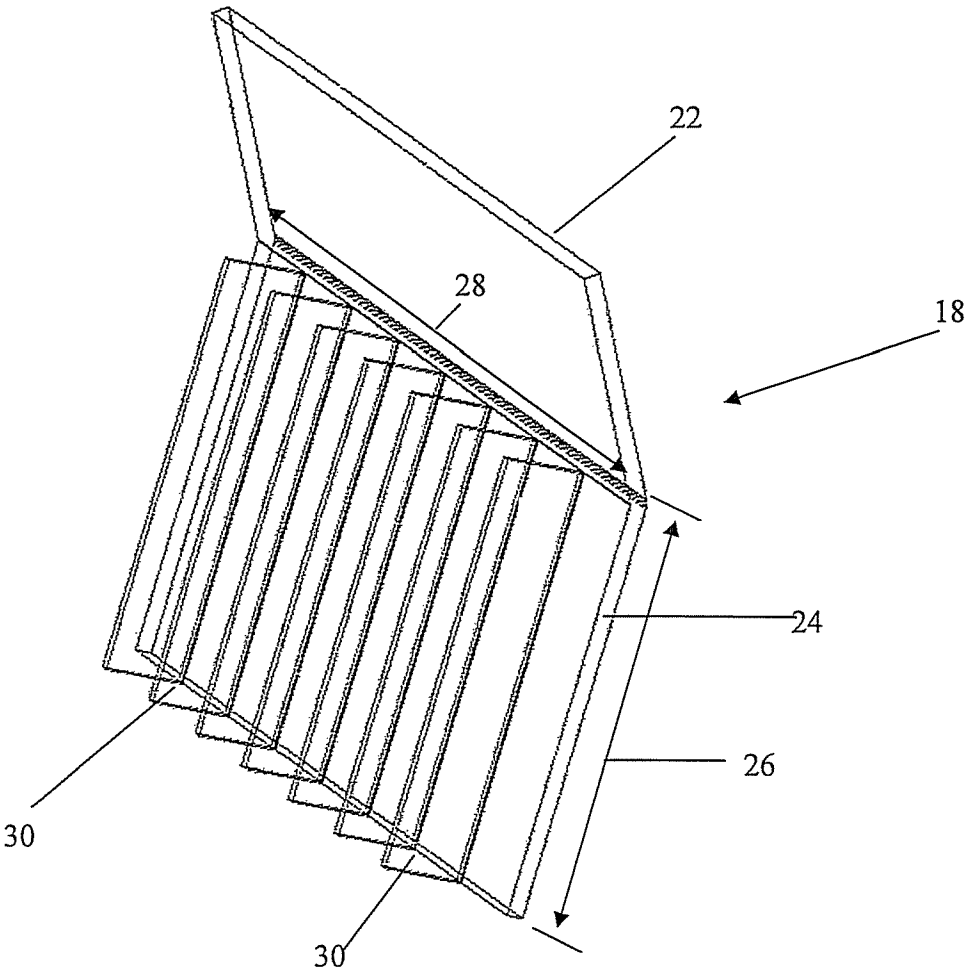
FIG. 3 is an isometric view of a louver heating unit.

In one possible implementation, each modular retort unit includes four pairs of louver heating and mixing elements. The louver units 18 are vertically staggered within the heating compartment 12 column. FIG. 2 is a side view of a single louver unit, and FIG. 3 is an isometric view of the louver unit. The louver unit includes a plate 20 with a first section angularly offset from a second section. FIG. 2 represents the orientation of the louver unit within a retort unit. In such an orientation, the upper first section 22 is substantially vertical and the lower second section 24 is offset 60 degrees from the upper section.

The lower section 24 defines a vertical height 26 and a transverse width 28. A plurality of heat sink fins 30 extend upwardly from the lower section. In one implementation, the heat sink fins are rectangularly shaped plates extending along the vertical height of the lower section of the plate. A plurality of plates are spaced along the transverse width of the lower section. In one particular implementation, the plates are spaced apart by about 3 inches. Other spacing arrangements, whether closer or further apart, are possible. Also, it is possible to angle the fins from vertical. Further, other heat sink arrangements are possible; for example, a flat heat sink plate, stacked plates, a plurality of posts (of different possible diameters) meshes, etc., may be used.

Figure 4:
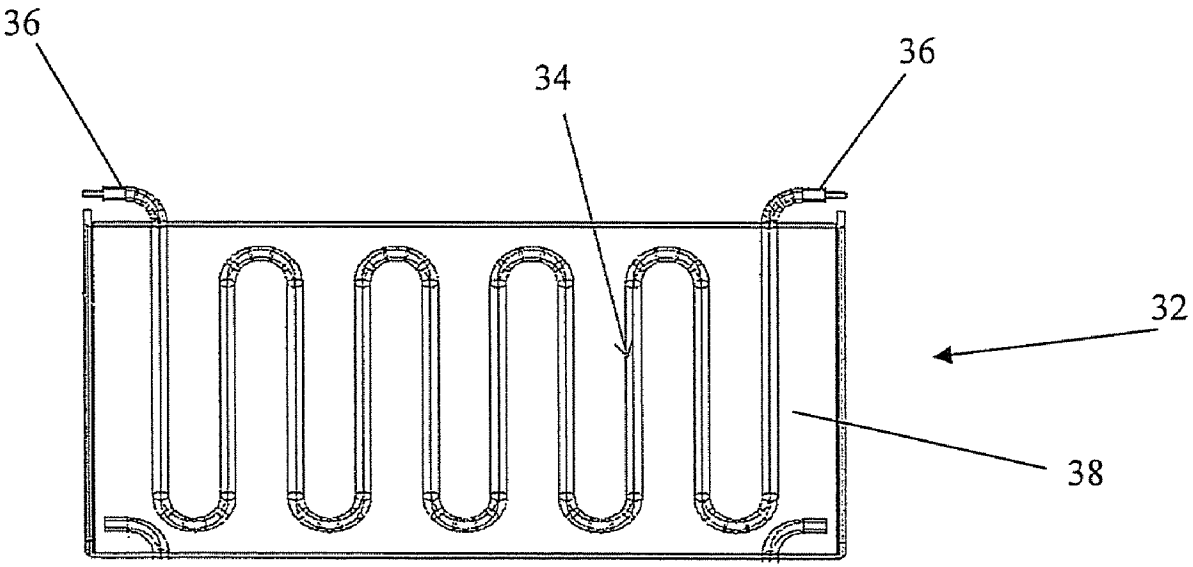
FIG. 4 is a top view of a heating compartment portion of the louver heating unit, the heating portion including a cal rod heating mechanism.

A heating chamber 32 is coupled with the lower section of the plate on the opposite side of the heat sink. FIG. 4 is a top view of one example of the heating chamber with a cal rod type 34 heating element disposed within the chamber. In this particular implementation, the cal rod defines a number or radiuses within the chamber, and a connector 36 at either end of the rod. The connectors are disposed outside of the heating chamber. In the implementation illustrated herein, the cal rods are cast within aluminum 38 or other material poured into the chamber. The aluminum distributes the heat substantially evenly to the lower section 24 of the plate where it is transferred to the fins 30. During operation, it is possible that the aluminum within the heating chamber will transition to a liquid state. Hence, in one specific implementation the chamber has no gaps or seams, at least along the sides and bottom, to prohibit aluminum in a liquid state from leaking from the chamber.

The heating chamber is coupled with the lower section of the plate along one side, and an insulation layer 40 is disposed on the lower section of plate opposite the heating chamber of the louver. The louver insulation facilitates heat transfer, from the louver heating unit, primarily to the heat transfer fins.

Figure 5:
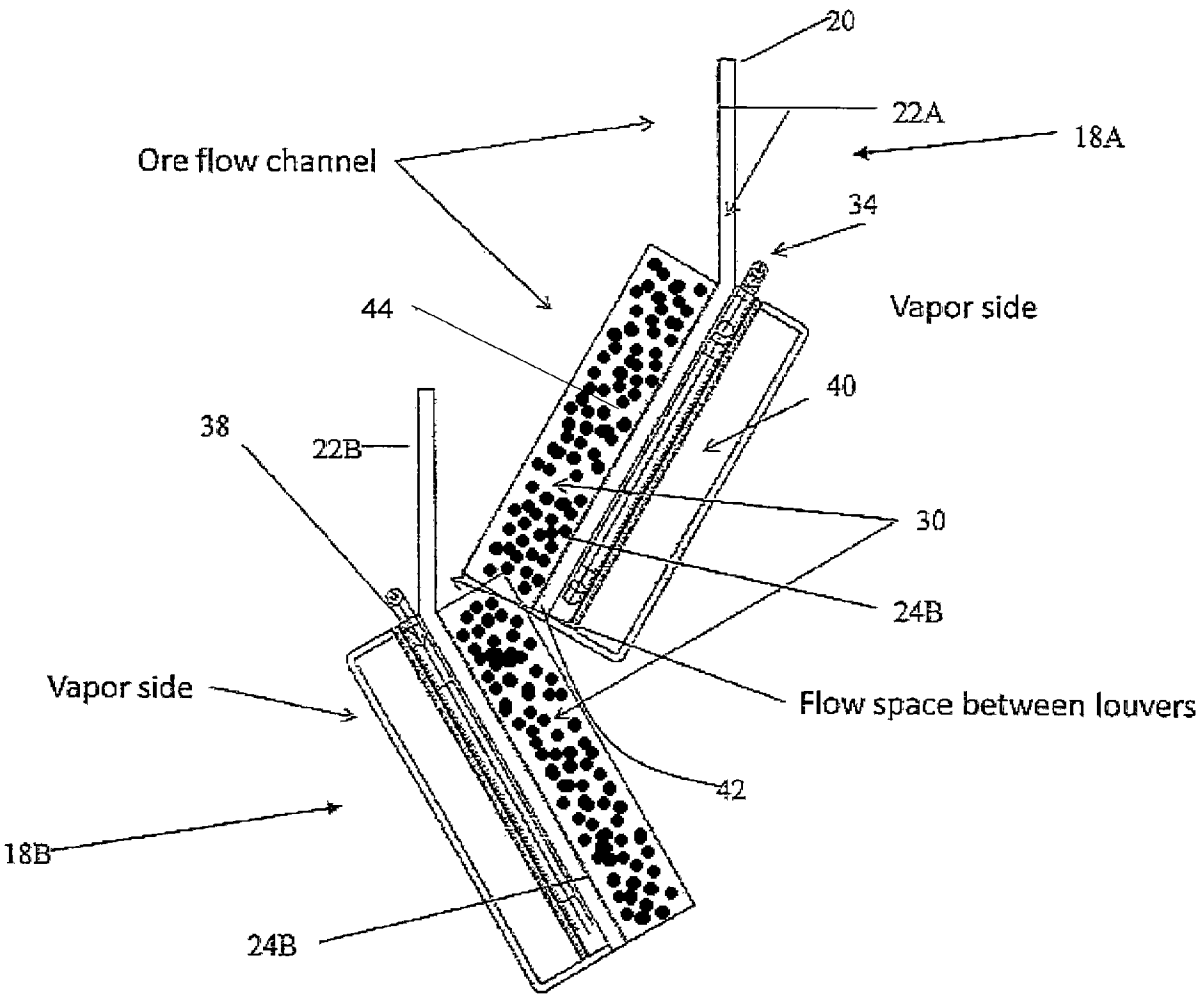
FIG. 5 is a side view of the pair of louver units shown in FIG. 2 and further illustrating the cal rod heating mechanisms and further illustrating the distribution of material within the heating compartment of the retort unit.
Figure 6:
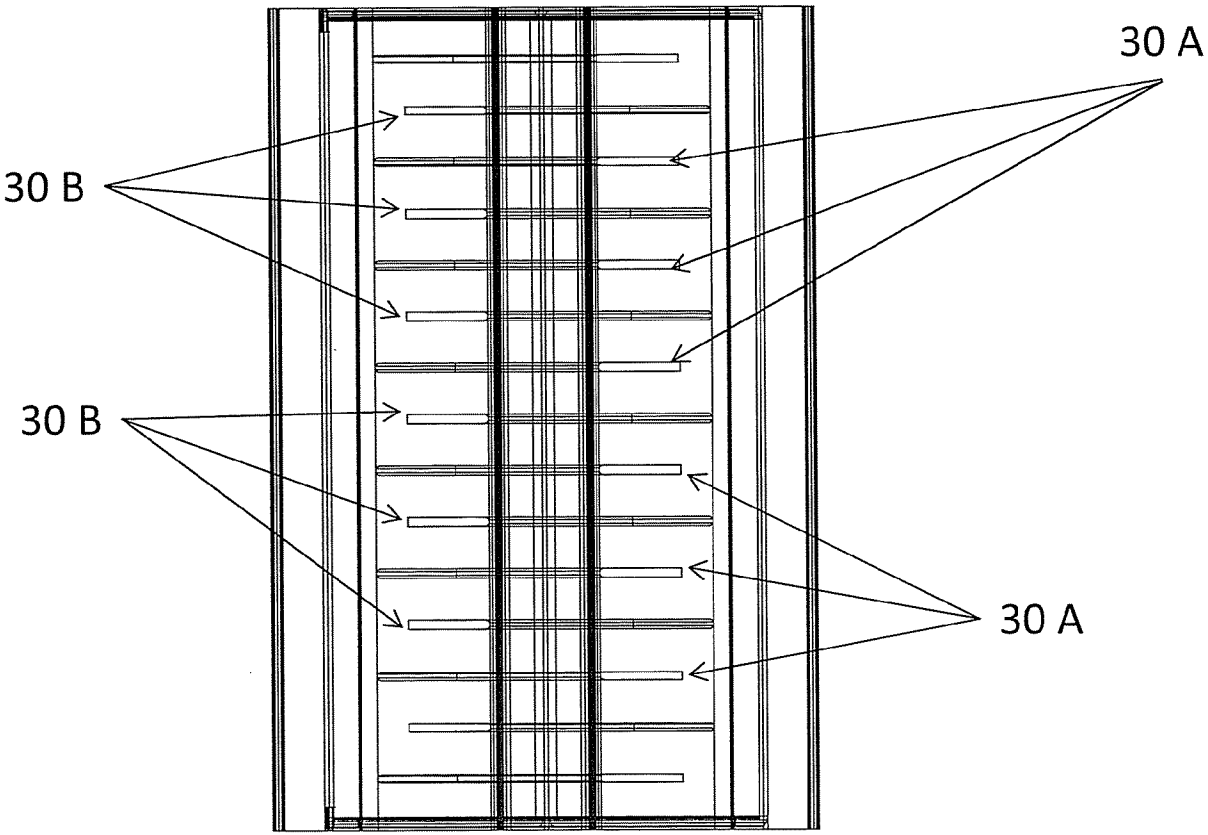
FIG. 6 is at top view of a pair of louver units disposed within a heating compartment of a retort unit, each louver unit including heating fins in a staggered arrangement with the other unit of the pair and with an upper unit of the pair configured to deposit coal on the heating fin area of the below unit.

FIG. 5 is side view of a pair of louver units (18A, 18B) and FIG. 6 is top view of the pair of units 18 illustrated in FIG. 5. As shown in FIG. 5, the lower section 24 extends inwardly (toward the other unit), and the lower louver unit 18B of the pair also includes a lower section 24B extending inwardly (toward but below the other unit). In this arrangement, a bottom edge 42 of the lower section of the upper unit is positioned above the lower section of the lower unit. The bottom edge 42 of the lower section 24B of the upper unit 18A is horizontally spaced about 3 inches from the louver plate 22B of the lower unit 18B. In one possible arrangement as shown herein, the bottom edge is horizontally spaced from the intersection of the upper and lower sections of the lower unit.

As best shown in FIG. 6, the fins 30A on the lower section of the upper unit are oriented to be between the fins 30B of the lower section of the lower unit. In one example, the upper fins are positioned a staggered midway between the lower fins. In one particular arrangement, the opposing fins are offset half the spacing of the fins. Hence, in a pair of louver units with the fins in the upper section spaced 3 inches, and the fins in the lower section spaced 3 inches, there is a 1.5 inch overall fin spacing within the pair of louvers. The spacing between fins, both on one louver and relative to the pair, effects flow rate through the unit and heat surface exposure to the coal or other material flowing through the unit. Staggering the fins facilitates mixing of the coal as it flows from the units.

FIG. 5, as well as some other figures discussed herein, also illustrates how raw material 44 flows through the heating compartment, and particularly over the louver units, as well as showing generally how the material is within the unit relative to the louvers. As the material flows initially into a unit, the depth of the material is approximately the same depth as the heat sink fins 30 (e.g., 3 inches) due to size of the gap between the bottom edge of the plate (e.g., upper unit) and the adjacent louver unit (e.g., lower unit). The material generally fills the area above the heat sink fins to the level of the upper section of the adjacent louver. The maximum depth of the material is defined as the distance between an upper edge of the upper section of plate and the adjacent lower section of plate. The maximum depth may be about 7 inches. Vapors flow from the material upward toward vapor ports, discussed in more detail below.

Figure 7:
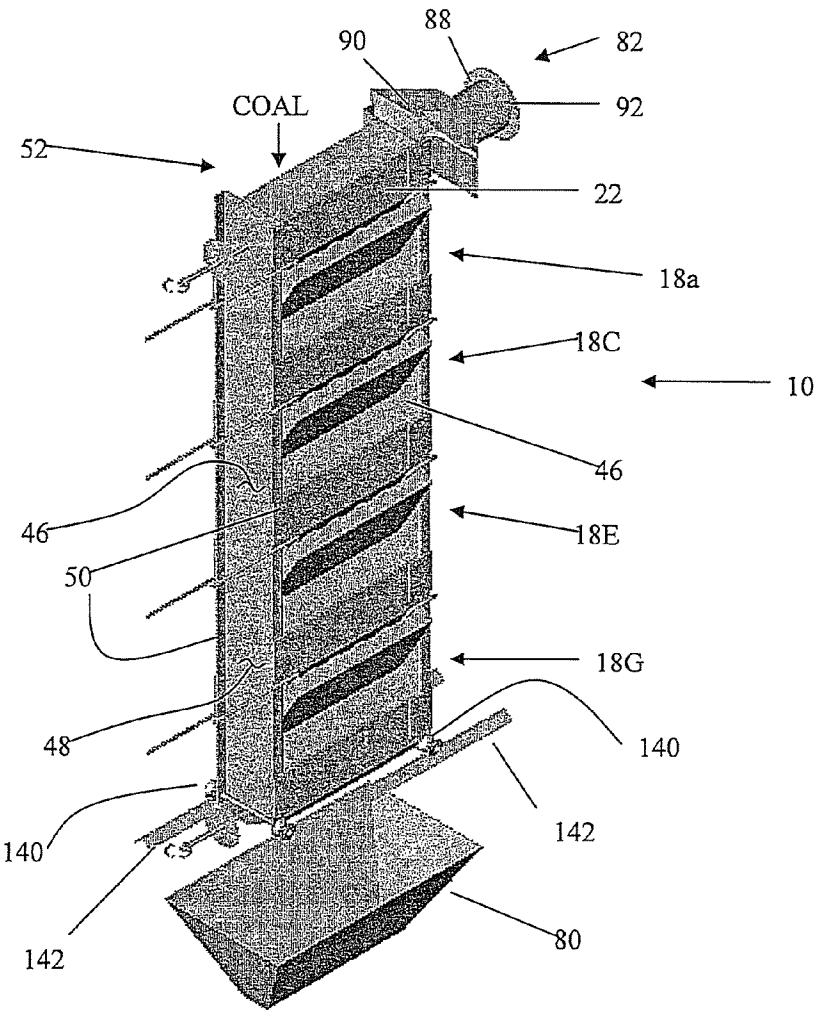
FIG. 7 is an isometric view of a retort unit.
Figure 8:
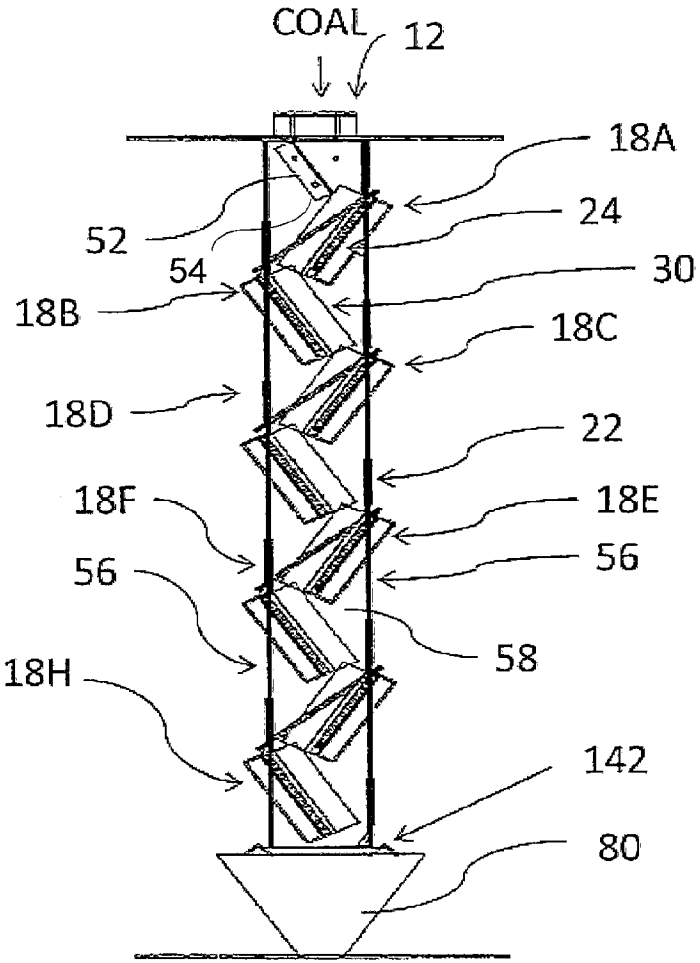
FIG. 8 is a side schematic view of the retort unit of FIG. 7.

FIG. 7 is an isometric view of various components of the modular retort unit. In FIG. 7, some of the outer components, such as the walls forming the vapor compartment 14 and the outer insulation 16 enclosing the vapor compartment, are not shown in order to fully illustrate various internal components, such as the louvers, and the relationship between the louvers within the retort unit. FIG. 8 is a side view of the modular retort unit shown in FIG. 7.

Referring now primarily to FIGS. 7-8, the modular retort unit 10 is configured such that coal is fed into the top of the unit and, by force of gravity in conjunction with rotary valves (discussed below) coupled with the top and bottom of the stack, the coal moves down through the unit. The unit includes side mounting plates 46 between which the louvers 18A-18H are connected. Each mounting plate includes a side wall section 48 and flanges 50 extending outwardly from the side wall section. At the top of the unit, a transition plate 52 is fastened between the mounting plates. The transition plate may be mounted at a 60 degree angle and with a bottom edge 54 positioned above the lower plate section 24 of a first louver unit 18A. Coal is initially deposited on the transition plate and the coal falls down onto the first section 22 of the first louver 18A and contacts the heating fins 30. In one particular configuration, the transition plate is spaced about three inches from the louver plate; hence, the material is deposited on the first louver unit through a three inch wide slot.

An upper section 22 of the first louver unit 18A (the vertically oriented section as shown in FIG. 2, for example) is connected to the front flanges 50 of each of the mounting plates. As discussed herein, each modular unit is designed to be removed or added from a stack of units. Hence, the components within the units can be maintained. To assist in maintenance, the louvers are bolted to the mounting plate flanges by way of coupling plates. Thus, when a unit is removed from a stack, the louver unit may be replaced. For example, if a cal rod 34 component fails, the louver unit (or pair of louver units) with the failed cal rod may be removed. The upper section of second louver unit (considered as the opposing pair to the first unit) is connected to the rear flanges of the mounting plates in the same manner as the first unit so that the first and second unit are arranged as shown in FIG. 5.

In one particular arrangement, the lower plate is 19 inches in overall height with the upper louver plate section being 7 inches in height and the lower louver plate section being 12 inches in height. Hence, vapor opening 56 is a little less than one foot in height. Further, the overall width of the heating compartment and each louver unit, is about two feet, the length of heating compartment is about 10 inches (corresponds approximately to the horizontal separation between the upper (vertical) plate sections of a pair of louvers), and the height (in an embodiment with four pair of lower units) is about nine feet. The vapor compartment has a width of about 3 feet and a height of about 1 foot 8 inches.

In operation, and as shown in FIG. 5, raw material will not typically occupy the space immediately below the lower sections of the louvers. Rather, coal fills in below the bottom edge of the lower section 24 of the louvers. Further, the flow rate of material through the unit may be maintained such that coal gathering on the heat transfer fins 30 of a louver does not reach a level such that it spills into the vapor compartment through the vapor opening 56 (i.e., material does not fill above the upper edge of an upper louver plate section 22). Hence, the area below the lower sections of the louvers is primarily a path for vapors 58 to escape into the vapor compartment 14. Any inadvertent spillage of coal pellets into the vapor chamber will be processed into the next unit along with any coal dust. With this design, the coal on and above the heat transfer fins is exposed or not covered by a great deal of material, which allows for an efficient path for vapors to escape through the opening into the vapor compartment.

Figure 9:
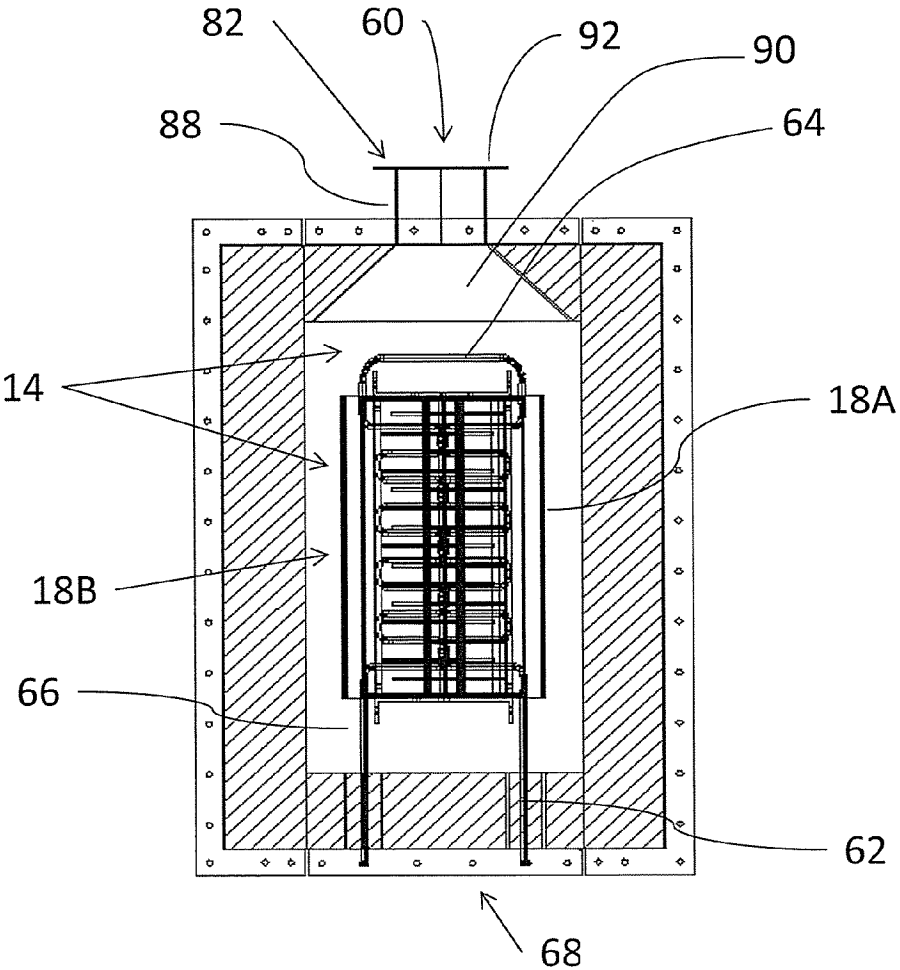
FIG. 9 is a top view of the retort unit of FIG. 7.
Figure 10:
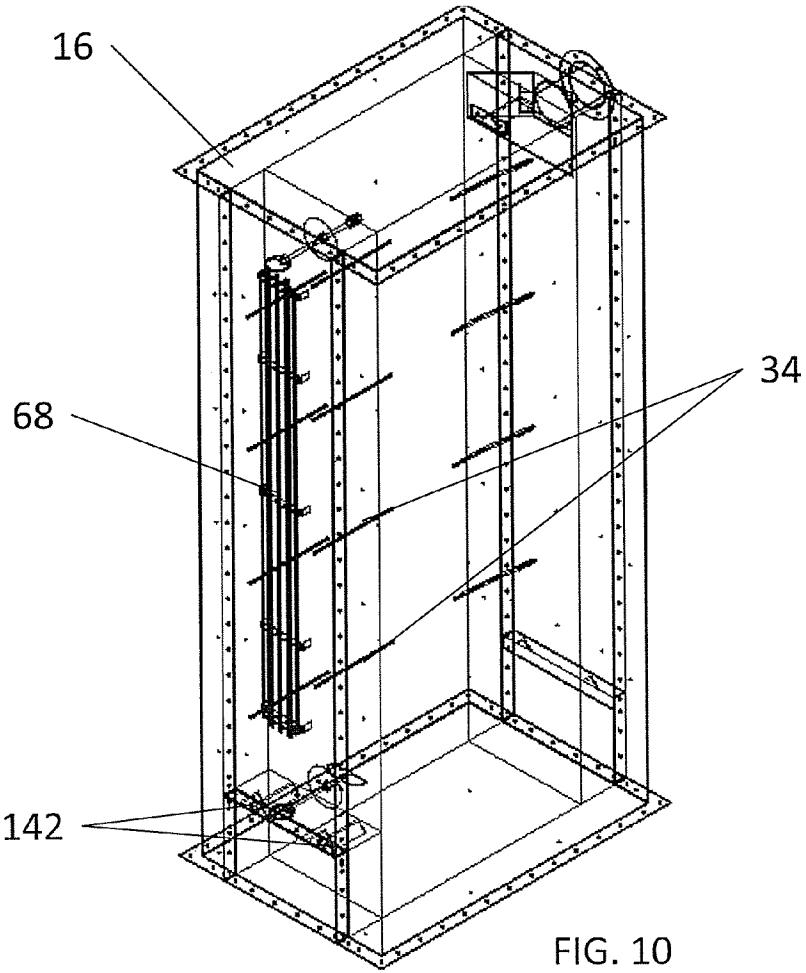
FIG. 10 is an isometric view of the retort unit of FIG. 7 illustrating various components not shown in FIG. 7.

FIG. 9 is top view of the modular retort unit 10, particularly illustrating the first and second louver units (18A, 18B), cal rod details and the vapor port. Referring now primarily to FIGS. 6 and 9, the cal rod units 34 of each pair of louver units 18 are interconnected. On the side of the retort unit, opposite the side with the vapor port 60, a first cal rod extension 62 is connected with the first louver unit cal rod. On the opposite side (same side as the vapor port), a connector 64 couples, the cal rod of the first louver unit 18A with the cal rod of the second louver unit 18B. A second cal rod extension 66 is connected with the second louver unit cal rod. The cal rod extensions extend horizontally away from the respective cal rods within the heating chambers of the upper and lower louver units; hence, the cal rod extensions are vertically offset by virtue of the respective louver units being vertically offset. The cal rod connector and extensions are sections of cal rod. FIG. 10 is an isometric view of a retort unit like shown in FIG. 7 but with various outer components visible. FIG. 10 illustrates the vertical staggering of the cal rod extensions.

As shown in FIG. 9, the cal rod connector is positioned within the vapor compartment 14. Each of the cal rod extensions extend through the vapor compartment to a bus bar and junction box 68 (See FIG. 10). At the junction box, the cal rod extensions are plugged into respective receptacles to energize the cal rods of the pair of louvers. Each modular retort unit is maintained, during operation, under vacuum. The cal rod extensions penetrate the side wall of the vapor chamber, and there is a seal at these locations. However, by intercoupling the cal rods of a pair of louvers, only two holes are needed to connect the cal rods to a power supply. Without intercoupling, an implementation might involve four holes, two for each cal rod. Hence, while a non-intercoupling implementation is certainly possible, by interconnecting the cal rods of a respective pair of louvers, the unit reduces the number of holes through the side wall of the vapor chamber, which in turn reduces the number of possible vapor leakage points.

Figure 11:
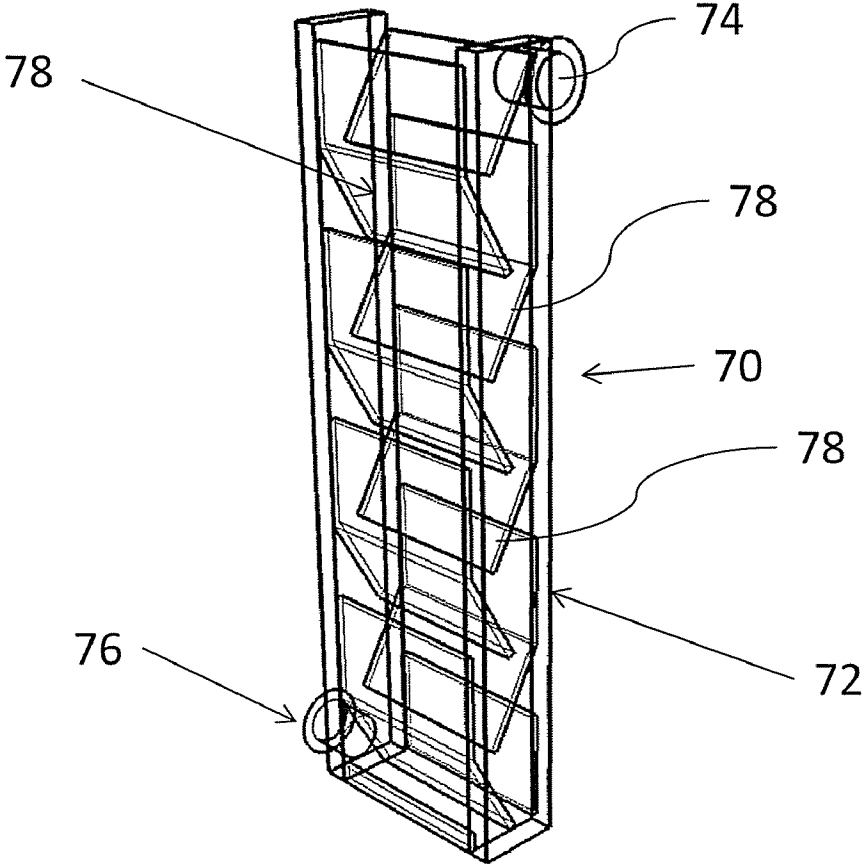
FIG. 11 is an isometric view of a retort unit employing a heat transfer fluid heating mechanism to distribute heat transfer fluid to the louver units.

Besides cal rod heating elements, other possible heating elements and configurations are possible. For example, FIG. 11 is a representative isometric view of the heating compartment portion of a retort unit 70 using heat transfer fluid to provide a heat source for the louvers in place of the cal rod units. In such an arrangement, a manifold 72 is integrated in the retort units, and heated liquid is supplied to the manifold at inlet 74 arranged at the top of the unit, and liquid is removed from the manifold at an outlet 76 the bottom of the unit. Each lower section 78 of a given louver defines a plurality of tubes (not shown) fluidly coupled with the manifold. Hence, heated fluids flow through the manifold, into a given louver, and back to the manifold. It is possible to define the manifolds and flow of heat transfer fluid in a number of ways. For example, the heated fluid flowing into the manifold may be directed to only one unit before flowing out for reheating, heated fluid may be directed and routed to flow downward to successive louver units before flowing out, heat transfer fluid may flow downward through successive units on each side of the unit (e.g., unit 1, 3, 5 then 7, and unit 2, 4, 6 and then 8). Hence, any number of possible fluid flow paths may be defined in the manifolds.

Referring again now to FIG. 8, a vapor opening 58 is formed between the heating compartment 12 and the vapor compartment 14. The vapor opening is defined by the insulation layer 40 of louver unit above an upper section of the louver unit for the louver unit below. The design facilitates the gentle flow of vapor from the heating compartment and into the vapor compartment, which, amongst other advantages, helps to prevent dust from rising up and out of the heating compartment. Also, the design places the vapor opening above and to the side of the material within the retort unit and below the insulation on the lower sections of the louvers, which allows some dust that initially rises up with the vapors to drop back into the material bed.

Vapors 58 from within the heating compartment flow through the vapor openings 56 into the vapor compartment 14. The raw material fed into the retort unit may have some portion of coal dust or other dust. To optimize the efficiency of the system, minimal or no dust should be expelled through the vacuum to the distillation tower, and secondly as much of the dust should be processed within the retort units as possible. Hence, the present design involves relatively large vapor openings 56 between the heating compartment and the vapor compartment (e.g., between 6"×12" to 4"×12"). The relatively large vapor opening in comparison to the area of coal expelling vapors through a given opening and the size of the heating chamber provides an opportunity for the coal to heat to appropriate temperatures and the vapors to escape the unit without the vapors, particularly "wet" vapors, from refluxing and condensing back into the coal within the retort unit. Recondensing of vapors into the coal bed would have a tendency to clump the coal particularly, dust particles in the coal bed, and clog the unit.

Further, with a relatively large opening, the vapors are not accelerated as they exit the chamber, and hence dust expelled into the chamber tends to fall downward within the chamber rather than cloud the chamber and be expelled through the vacuum. Moreover, if the vapors and dust are jetted at high velocity into the vapor compartment, the dust and vapor will tend to collect in the vapor extraction system and eventually build up to levels that impact the performance of the extraction and condensing systems.

As shown in FIG. 7, at the bottom of each retort unit, and in fluid communication with the heating chamber and vapor chamber, is a discharge funnel 80. Dust expelled from the heating chamber with the vapors may fall down into the discharge funnel and flow into the next (below) retort unit for further heating and processing, unless it's the bottom unit and then the dust mingles with the char. Hence, in the implementation illustrated herein, coal dust is not blown into the distillation tower; rather, coal dust is processed to a substantial extent to extract a significant portion of vapors.

Figure 12:
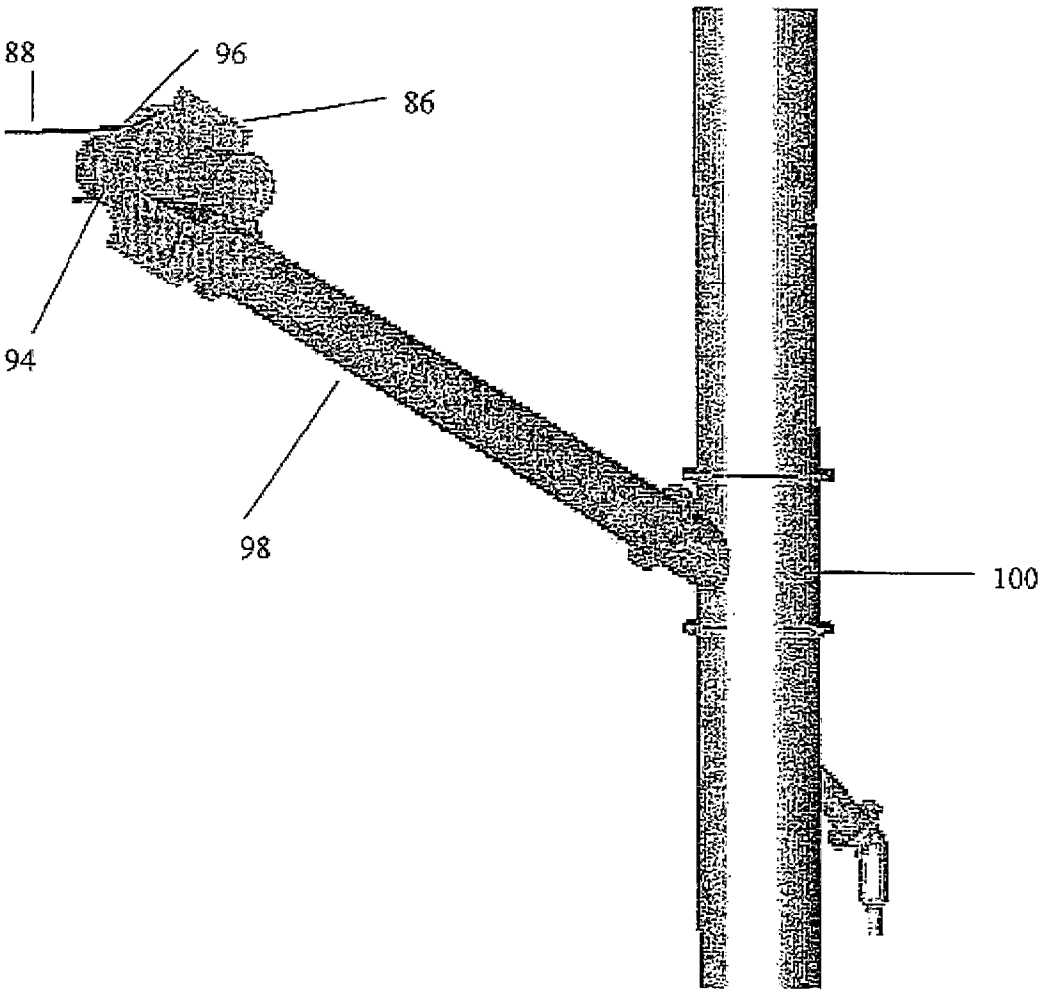
FIG. 12 is an isometric view of a vacuum assembly and condenser column coupled with a retort unit.

At the top of the retort unit, a vapor vacuum assembly 82 is positioned to extract vapors from the vapor chamber 14 and direct those vapors into a distillation column 84. FIG. 12 illustrates the vacuum assembly including a vacuum fan 86 coupled with the tubular portion of a vapor port 88. Referring to FIG. 9, the vapor vacuum assembly includes the vapor port 86 with funnel opening portion 90 embedded in the insulation layer surrounding the vapor compartment, and a tubular portion extending from the funnel through the retort unit side wall. The tubular portion defines a circumferential flange 92 distal the funnel opening.

Referring now to FIG. 12, the fan has a tubular member 94 with a circumferential flange 96 matching the circumferential flange of the tubular portion extending from the side wall of the retort unit. The flanges are bolted together to connect the fan to the vapor port. The vacuum fan is connected to a vapor tube 98 that is connected to a condenser tray 100 of the condenser column. The vacuum fan places a vacuum on the retort unit and also pulls vapors from the vapor compartment, which are conveyed to the condenser tray (and condenser column) by way of the vapor tube. In some arrangements, the vacuum fan speed is variable to control the amount of vacuum on the system and to create a slit pressure or flow through the condensing tower.

Figure 13:
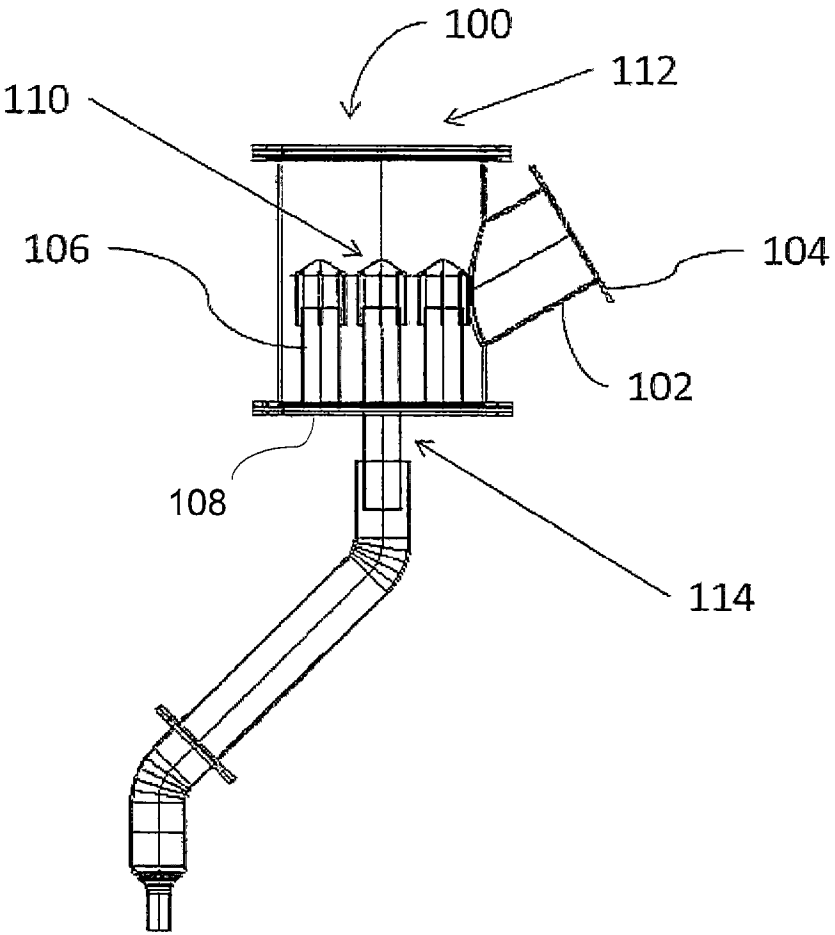
FIG. 13 is a side view of a distillation tray.

FIG. 13 is a side view of a distillation tray 100 that is positioned in the distillation tower and configured to receive vapors from the vapor tube. In the embodiments illustrated herein, there is a distillation tray within the distillation column, and each retort unit forces vapors into the distillation tray. Within the distillation tower, vapors are condensed both above and below the tray. The distillation tray has a cylindrical side wall, with a circular opening. A vapor input cylinder 102 is coupled with the opening, and extends upwardly and away from the circular opening at an angle. The vapor input cylinder may define a circumferential flange 104 configured to couple with the vapor tube 98. In the configuration shown, vapors flow downwardly and at an angle into the distillation tray from the vapor tube. A plurality of vapor (riser) tubes 106 extend upwardly from a floor 108 of the distillation tray. In the embodiment shown herein, there are five vapor tubes circumferentially spaced. Any non-condensed vapors rising up from the distillation tower below the tray, flow up into the distillation tray through the vapor tubes. Each vapor tube includes a conical vapor tube cover 110. The vapor tube cover is connected with the top of the vapor tubes so as to define a plurality of openings. The vapors flow out of the openings and rise up through one or more apertures 112 defined in the top of the tray, and into the distillation tower above the tray. Similarly, vapors flowing into the tray from the retort flow upward in the distillation tower above the tray. Through the same apertures, condensed fluids flow or down into the vapor tray. A drain 114 is defined in floor of the tray. The drain may be coupled with a tank and is configured to carry away any condensed fluids within the tray. The floor of the tray may be slightly downwardly conical to direct any liquids to the drain hole. The tray is also arranged such that any dust collecting within the tray can be washed out through the drain hole.

As shown in FIG. 7, a vapor stop is created by each discharge funnel. The vapor stop provides for a minimum amount of commingling of the vapor from one unit to another so the hotter vapor does not condense on the colder product in the process to make it sticky or crack the colder vapors beyond condensation recovery. In the retort system implementation illustrated herein, the vapor chambers of each retort unit are isolated from the vapor chamber of any connected retort unit, whether above, below or both, which substantially prevents, by way of the vapor stop and other components, the commingling of vapors.

Figure 14:
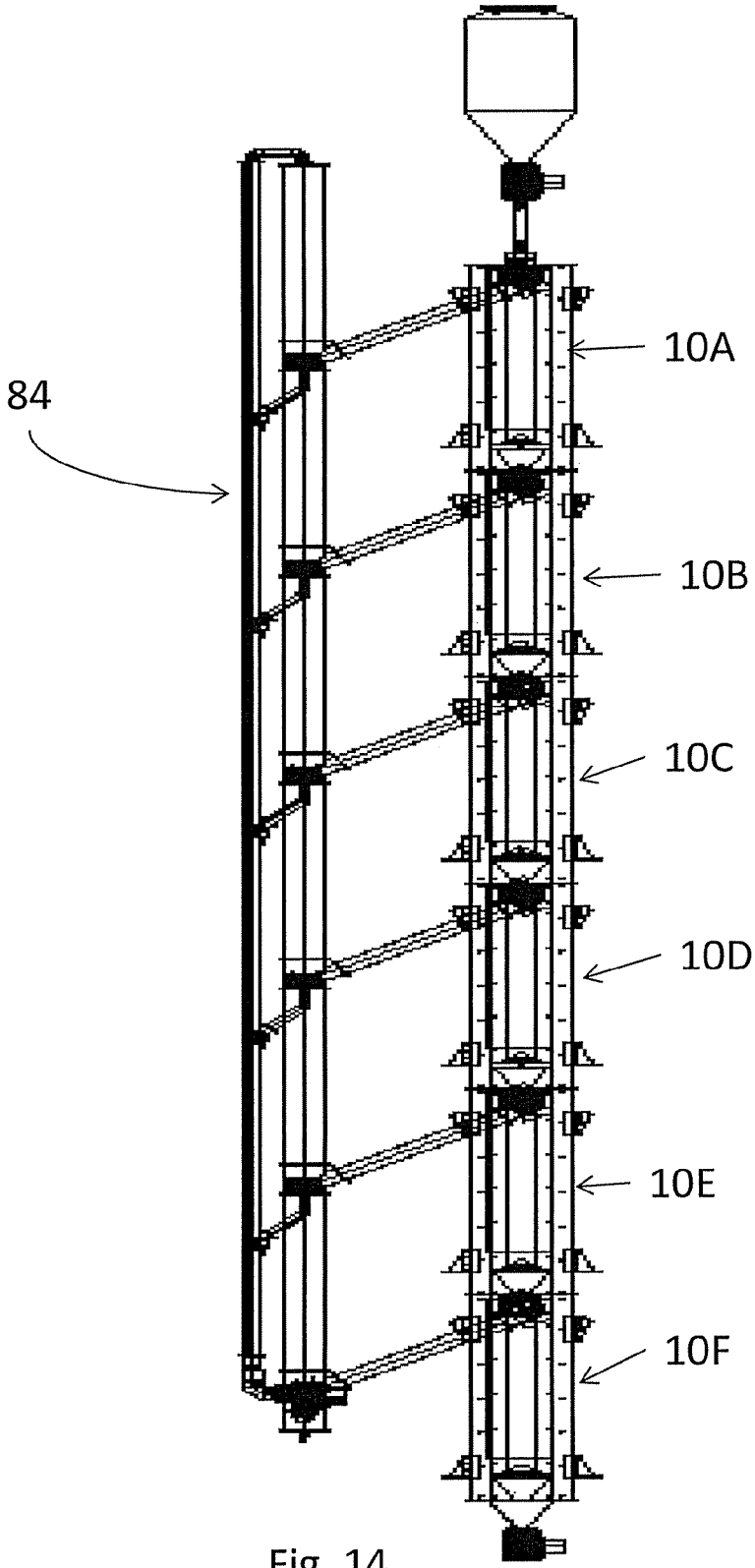
FIG. 14 is a side view of a retort unit stack coupled with a distillation or condenser column, the process unit stack including six retort units in fluid communication and configured to sequentially process raw material fed into the top retort unit.

FIG. 14 illustrates one possible system implementation with six modular retort units 10A-10F stacked, and with each modular unit individually coupling the respective vapor port to a common distillation tower 84. In such an arrangement, whether with six units or with more or less, pelletized coal or other material is fed into the top unit 10A, various operations may precede the provision of coal or other material into the retort system.

One preprocessing example is crushing otherwise pelletizing the raw material, referred to sometimes as "sizing". In one arrangement, the raw material may be crushed or otherwise processed into ⅜" or less sized pellets. Generally speaking, crushing the material allows heat within each unit to more rapidly heat individual pellets than with larger pellets. Retort systems conforming with the various arrangements discussed herein may be scaled or otherwise modified to process larger sized raw material, which may involve increasing scale of various components, altering the flow rate of material through the system, increasing temperatures within each unit, and the like. The crushing operation may also involve a screening operation, where pellets of a size larger than specified (e.g., greater than ⅜") are reprocessed in the crusher.

In another example, particularly dirty coal might be washed prior to processing in the retort system. Coal and other possible raw materials, such as oil shale, often contain a significant percentage of water. Hence, in another preprocessing example, the raw material may be dried. The retort system will likely operate more efficiently if the coal is dried to remove moisture prior to processing in the retort. The drying process is performed at a temperature above 212 degrees Fahrenheit, and in various possible ranges, but in such a way as to avoid ignition of the raw material. In one particular implementation, the drying operation preheats the raw material to a nominal 220 degrees Fahrenheit. In an implementation where the dried coal may be exposed to air (no vacuum), the coal is maintained at a temperature below 230 degrees so that the coal does not ignite or give up hydro carbon vapors prior to being fed into the retort system. Thus, in one implementation, dried coal is preheated to a temperature between about 210 and 230 degrees Fahrenheit and is fed into the retort system.

Figure 15:
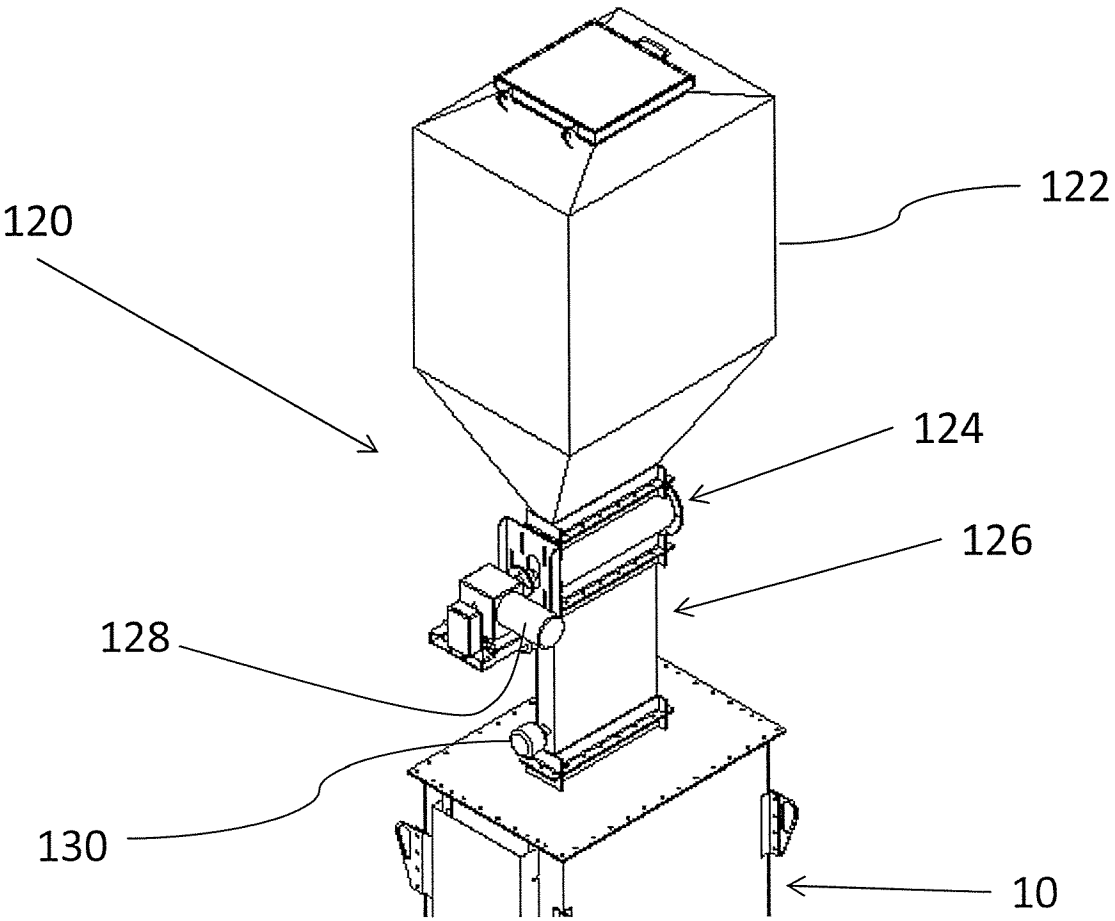
FIG. 15 an isometric view of the a material bin, rotary valve, and surge bin along with other components coupled with the top of process unit stack and configured to feed material into the top retort unit.

Irrespective of the preprocessing steps, the raw material is fed into the heating compartment of the upper, first, retort unit. FIG. 15 illustrates one possible arrangement of a feeding assembly 120 that provides coal into the top retort unit 10. The feeding assembly includes a bin 122 that is filled with raw material from a conveyor belt (not shown) or other possible means. The bin is kept full of material and hence the provision of material into the bin is typically matched to the feed rate of material into the bin. Since various factors can affect the feed rates to the bin, out of the bin, through the retort units, and the like, the volume of material in the bin creates a surge buffer between the feed rates, where the level in the bin may go up and down, but so long as the bin does not completely empty, the material flowing into the retort units stays relatively steady. Hence, the surge bin keeps a head of material on top of the top process unit.

Below the material bin is a rotary valve 124 that feeds material into a surge bin 126. The rotary valve may be controlled by a pair of switches (an upper level switch 128 and a lower level switch 130). The bottom level switch turns the rotary valve on when the material flows below the switch probe, whereas the top level switch turns the rotary valve off when the material fills to the switch probe. The level switch surge bin shown may vary in size or shape, but will provide a free flow of material into the unit. The large material bin is to provide a large volume of material to be used at the demand of the rotary valve.

From the surge bin, the pellets drop down onto the transition plate 52 or directly on the heat fins 30 of the top unit 18A. In order to control the heating of the material as it flows through the retort system and to control the flow material through the system, it is possible that the retort unit will be prefilled with raw material. In preheating the system, the raw material within the top unit will be fully processed through each stage (i.e., through each of the stacked retort units), but the prefilled material in the lower units will be heated to various degrees but likely not fully. Hence, a portion of the prefill material can be recirculated through the full system in order to fully process the material.

The arrangement of the fins, the angular orientation of the lower sections of the louvers, the alternating louver arrangements (i.e., the first 18A, third 18C, and fifth units 18E being on one side of the unit, and the second 18B, fourth 18D, and sixth units 18F being on the opposite side), the offset fins, the size of the heating compartment, collectively and individually cause the material to circulate and mix as it flows downward through the retort unit. For example, the coal pellets dropping down through the unit flow between the fins, and when they drop down to the next louver unit, they may be mixed due to the fins of the lower unit being spaced between the fins of the upper unit. The coal pellets also undulate and roll as they flow over the units, and eventually drop down to lower units.

The mixing of the material within each retort unit achieves several results. First, mixing provides more uniform heating of the material as compared with a unit that does not mix or mixes less than the unit disclosed herein. Relatively uniform heating allows each pellet to expel the same vapor types within each retort unit stage. Hence, substantially the same vapor types are provided to the distillation tower from each retort unit. The fins and the arrangement of the louvers also helps to uniformly heat the pellets. Second, mixing helps to avoid clumping of the material.

Figure 16:
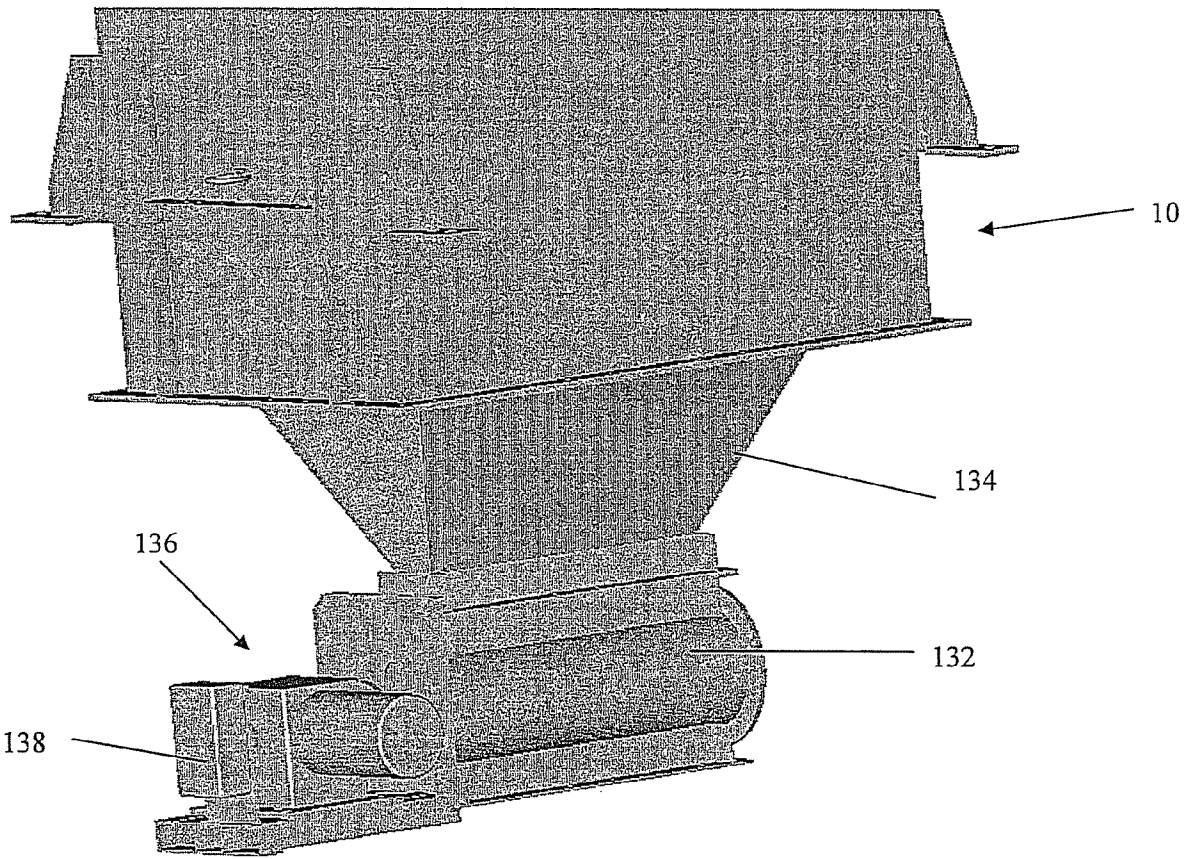
FIG. 16 is an isometric view of a discharge funnel and rotary valve coupled with the bottom retort unit in the stack, the rotary valve delivering processed raw material, such as a cola char, from the stack of retort units.

At the bottom of the stack of retort units, the retort system includes a rotary valve 132 configured to control the flow of material through each unit and through the stack of units. FIG. 16 illustrates an isometric view of one example of a rotary valve 132 coupled with the bottom retort unit. Below the heating chamber of the retort unit 10, a discharge funnel 134 directs material from the heating compartment to the rotary valve. The discharge funnel may be bolted to the bottom of the unit so that the unit can be disconnected, and in such a manner as to prevent escape of vapors from the vapor chamber. A gear motor 136 is coupled to the rotary valve to drive the rotary valve. The motor may be controlled in various ways, including a program that the alters the speed of the rotary valve to control the flow of material through the units based on temperature and well time. Hence, the temperature at various locations of a given retort unit or in the stack of units, is monitored, and the flow of material is controlled so that the temperature within the units or stack of units is maintained within predetermined ranges.

The bottom rotary valve may be controlled by a timer switch 138, and configured to cycle on and off. In one arrangement, the switch is controlled by the temperature of the units. The temperature should be the maximum required for the final extraction at the bottom unit, and should maintain that temperature for the dwell time of that unit (e.g. 10 minutes). The switch may be a reversing switch that turns the valve one way for a given number of revolutions and the other way for a given number of revolutions to prevent uneven extracting of material from one side of the unit or the other.

In the implementation shown herein, one or more heat sensors may be coupled with the heating compartment of each retort unit. Through a programmable logic controller, or other control mechanisms, coupled with the heat sensors, and configured to actuate a switch coupled with the gear motor, the temperature of the coal within each unit can be maintained substantially within predetermined temperature ranges. Through such temperature control, each retort unit can be designated to deliver specific vapor types to the distillation tower.

Through successive heating and vaporization stages of the stacked retort system, several advantageous events can occur. First, water, hydrocarbon gases, oil products, contaminants and some sulfur are vaporized and released from the coal or other raw material. These vapors are initially contained within the vapor chamber, without leaking or escaping into the environment, and are pulled by the vacuum from the retort unit and conveyed to the distillation column. Secondly, the distillation column receives the gases from the retort units and condenses them into liquid. The distillation column may be arranged to condense the vapors into a single liquid suitable for further refining. Alternatively, the distillation column may be arranged to condense the vapors into various refined (ready for market) oil products, such as gasoline, kerosene, and diesel fuel.

Thirdly, by vaporizing and otherwise removing various liquids, toxins, hydrocarbons and the like, from the raw coal material, the retort unit delivers a cleaned coal char. The char may then be burned in various possible electrical generation facilities and emit less pollutants during burning as many of the hydrocarbons, toxins, etc., are removed from the raw material during retort processing.

The temperature of the char delivered from the retort units may be in a range of 900 to 1030 degrees Fahrenheit. In order to avoid char ignition and to make the char suitable for storage and transport, the char is cooled and may also be routed to a heat exchanger of the drying units as well as routed to a generator or other power system to provide power to the retort units. The generator may be arranged to power various retort unit components, such as the cal rods, the PLCs, conveyors, etc. Hence, once the system is started and reaches stable operating temperatures, it may be a closed power system.

The retort unit may be configured for easy addition or removal from a stack of retort units. Hence, in one possible implementation as illustrated in FIG. 7, a plurality of track rollers 140 are mounted to the bottom of the retort unit. More particularly, four rollers may be mounted adjacent each bottom corner of the retort unit, with the track rollers configured to engage respective tracks 142 mounted in a frame that receives the retort unit. In the FIG. 7 implementation, there is an upper and lower tug or other coupling mechanism mounted near the top and bottom of the retort unit. Hence, a wench or other device may be configured to pull the retort unit from the stack.

Figure 17:
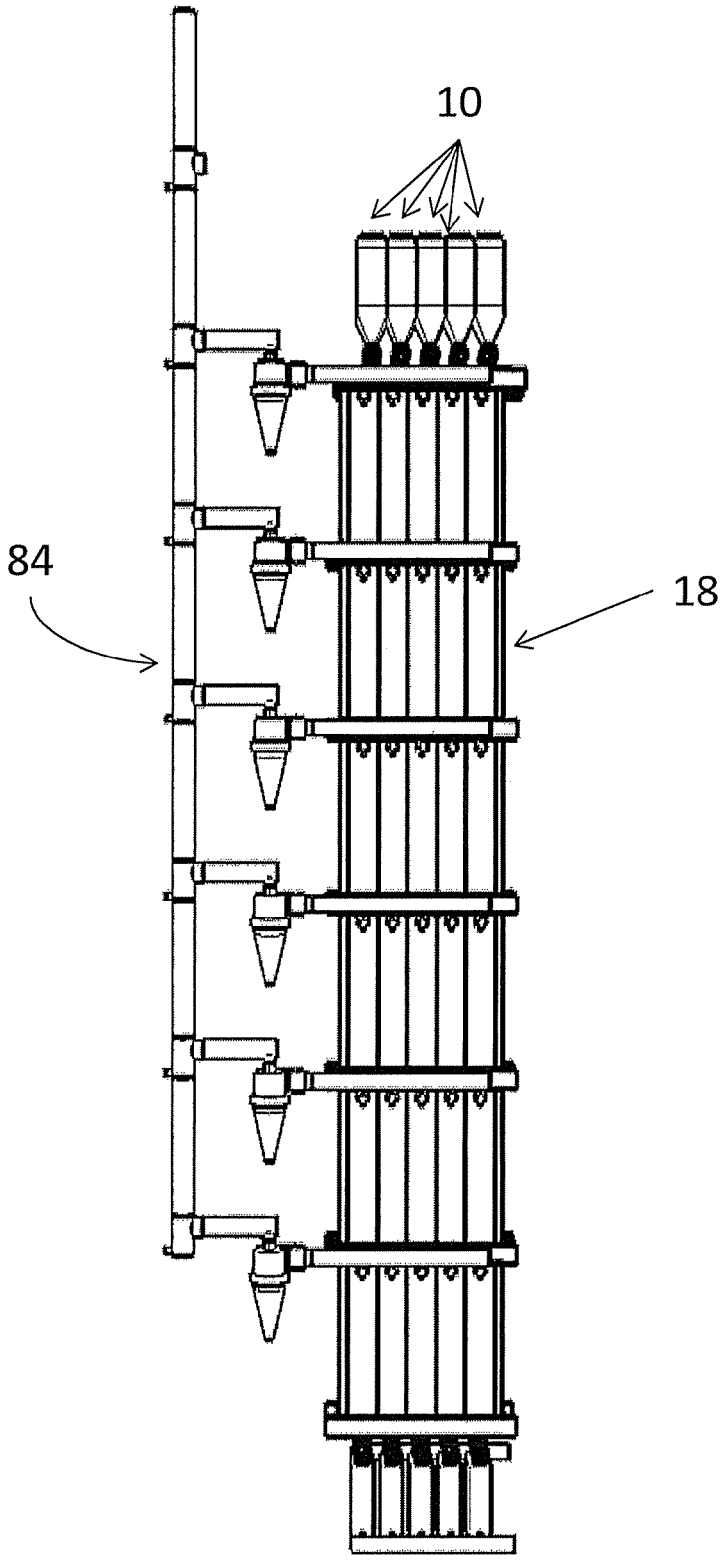
FIG. 17 is a side view of a plurality of retort unit stacks feeding vapors into a common distillation tower.
Figure 18:
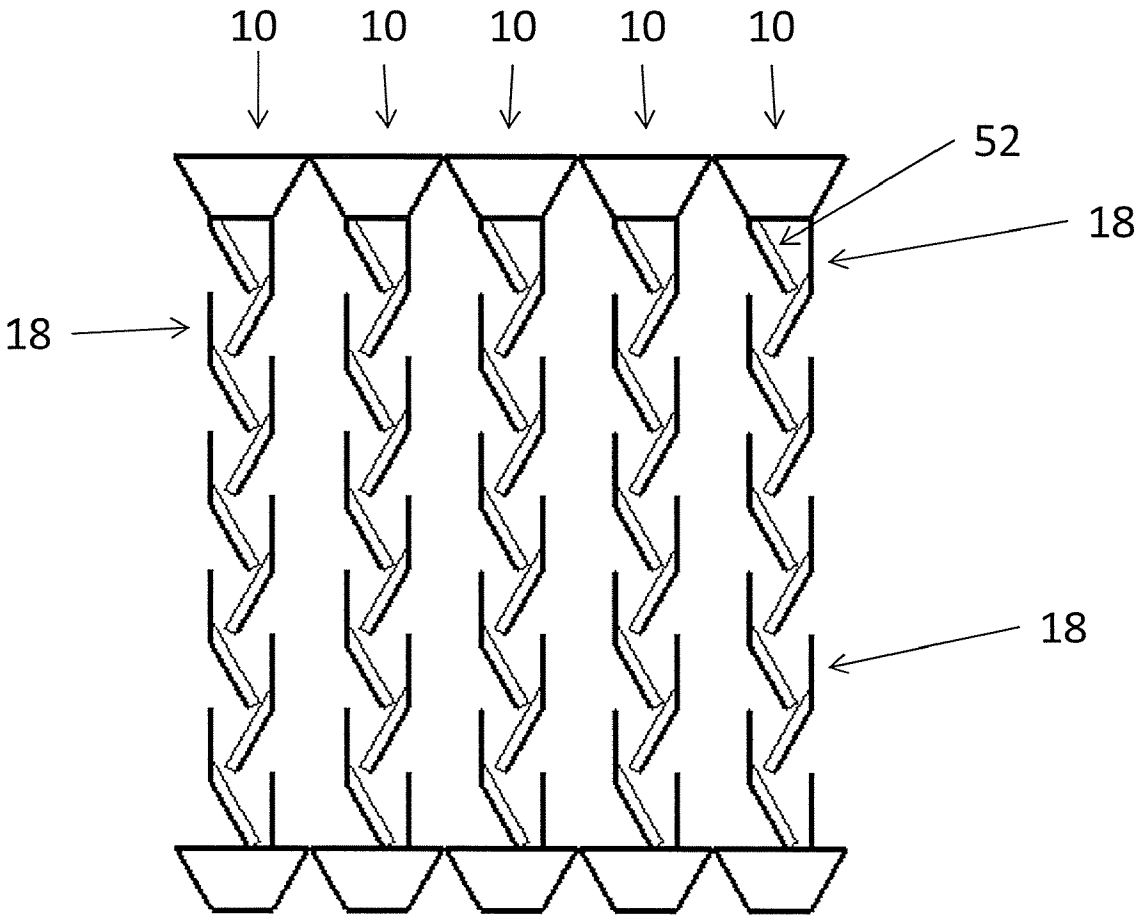
FIG. 18 is a representative side view of a plurality of retort unit stacks.

FIGS. 17 and 18 illustrate possible arrangements for using a plurality of retort unit stacks 10 arranged side by side, and configured to deliver vapors to a common distillation tower. In this example, the vapor port for each retort unit is connected to a common vapor vacuum. Hence, one vacuum services five retort units, it is possible to have more or less in any given implementation. The common vacuum directs vapors into a cyclone mechanism that separates dust from the vapors, and then the vapors are fed into the distillation tower.

Figure 19:
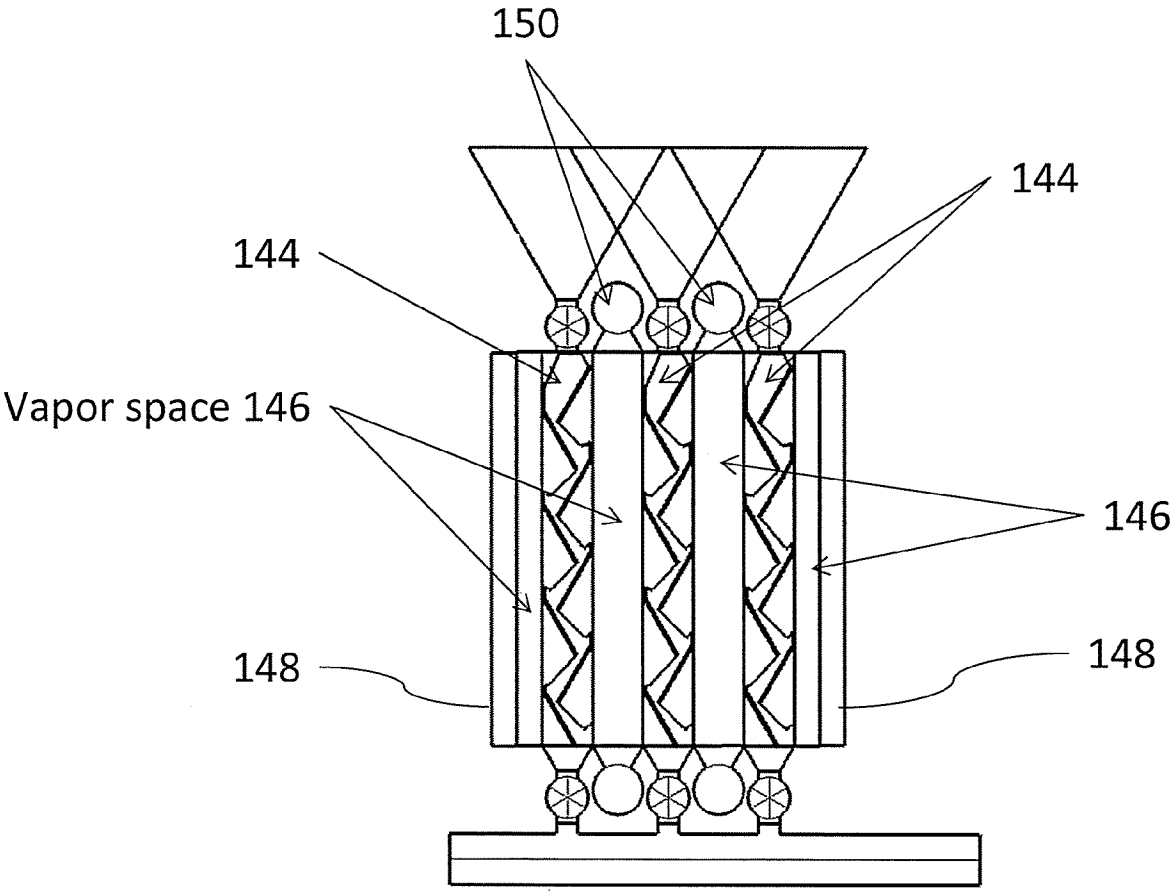
FIG. 19 is a representative side schematic view of a retort unit with a plurality of heating compartments configured to expel vapors from material within the heating compartments into a common vapor compartment.

FIG. 19 illustrates an alternative arrangement where three heating chambers 144 provide vapors to a common vapor compartment 146. A vapor compartment surrounds each of the three heating compartments, such as the vapor compartment has two interior portions between the first and second heating compartments, and between the second and third heating compartments. The vapor compartment further defines an outer area that surrounds the three heating compartments. An insulation layer 148 surrounds the outer portion of the vapor compartment. In this arrangement, two vacuum assemblies 150 extract vapors from the vapor compartment. A first vacuum assembly is arranged at a top area of each of the interior portions of the vapor compartment. Material is fed into the top of each heating compartment in the same manner as discussed with respect to the above described retort units, and processed material is discharged from the bottom of each heating compartment in the same manner as discussed above. In this example, each heating compartment includes four pairs of louvers. However, more or less pairs may be provided depending on the material being processed and the vapor extraction products desired. Additionally, a plurality of multiple heating compartment units may be stacked, and manufactured with a similar framework as the single heating compartment units discussed above.

Dimensions and relational arrangements for various components of the retorts discussed herein are merely representative of one possible way of arranging the retort unit. For example, the angular relationship between the upper and lower sections of the louvers may be more or less than 60 degrees, so long as the material designating for any given retort unit can flow through the chamber and dwell sufficiently to heat the material to a desired temperature. The size, spacing, and staggering of heat sink fins may be altered in any given design. In fact, other heat sink arrangements might be employed. The overall size of the heating compartment (height, width, and/or length), vapor openings between the heating compartment and vapor compartment, and the size of the vapor compartment may be altered in any given implementation. The implementations discussed herein illustrate four pairs of louver units; however, more or less pairs of louvers may be employed. Further, louvers may be deployed singly (not as pairs). Pairing the louvers does, however, provide an advantage of being able to supply power to the cal rod heating units of a pair of louvers, as discussed herein with respect to the louver implementation employing cal rods rather than some other form of heating element.

Although the present invention has been described with respect to particular apparatuses, configurations, components, systems and methods of operation, it will be appreciated by those of ordinary skill in the art upon reading this disclosure that certain changes or modifications to the embodiments and/or their operations, as described herein, may be made without departing from the spirit or scope of the invention. Accordingly, the proper scope of the invention is defined by the appended claims. The various embodiments, operations, components and configurations disclosed herein are generally exemplary rather than limiting in scope.

The invention claimed is:

1. A retort unit comprising:

a heating compartment surrounded by a vapor compartment, the heating compartment defining a plurality of passages where vapors emitted from a material within the heating compartment flow into the vapor compartment, the heating compartment further including:

at least a first louver unit including a first plate with a first lower section angularly positioned relative to a first upper section, the first lower section having a first side and a second side opposite the first side, the first side of the first lower section including a plurality of heat sink fins substantially aligned with a flow of the material over the first louver unit and a first heating element adjacent the second side of the first lower section, the first heating element configured to heat the material within the heating compartment and being interposed between the heat sink fins and a first insulation layer disposed on the second side of the first lower section; and at least a second louver unit including a second plate with a second lower section angularly positioned relative to a second upper section, the second lower section having a first side and a second side opposite the first side, the first side of the second lower section including a plurality of heat sink fins substantially aligned with a flow of the material over the second louver unit and a second heating element adjacent the second side of the second lower section, the second heating element also configured to heat the material within the heating compartment, and being interposed between the heat sink fins and a second insulation layer disposed on a second side of the second lower section, wherein the second lower section is spaced below at least a portion of the first lower section such that the plurality of heat sink fins coupled to the first side of the first lower section extends inwardly toward the plurality of the heat sink fins coupled to the first side of the second lower section so that material flowing over the first lower section of the first louver unit is deposited on the second lower section of the second louver unit so that the plurality of heat sink fins coupled to the first side of the first lower section are staggered relative to the plurality of heat sink fins coupled to the first side of the second lower section.

2. A retort unit of claim 1 wherein each of the plurality of heat sink fins extends upwardly from each of the lower sections.

3. A retort unit of claim 1 wherein the heating fins are rectangularly shaped plates extending along the vertical height of the lower section.

4. A retort unit of claim 1 wherein the first heating element comprises a first heating chamber coupled to the first lower section of the first plate and the second heating elements comprise a second heating chamber coupled to the second lower section of the second plate.

5. A retort unit of claim 4 wherein the heating chambers further include a cal rod type heating element disposed within the chambers cast within aluminum.

* * * * *